United States Patent [19]

Hixson

[11] 4,061,269

[45] Dec. 6, 1977

[54] RESTRAINING RAIL MOUNTING ASSEMBLY

[75] Inventor: Richard M. Hixson, McLean, Va.

[73] Assignee: Transit Products Company, Inc., Washington, D.C.

[21] Appl. No.: 669,109

[22] Filed: Mar. 22, 1976

[51] Int. Cl.[2] ..... E01B 5/18

[52] U.S. Cl. ..... 238/17

[58] Field of Search ..... 238/17, 18, 19, 20, 238/21, 22, 23, 264, 282, 310, 347

[56] References Cited

U.S. PATENT DOCUMENTS

| | | | |
|---|---|---|---|
| 978,996 | 12/1910 | Fallon | 238/17 |
| 1,108,881 | 9/1914 | Banker et al. | 238/20 |
| 1,463,943 | 8/1923 | Fallon | 238/20 |
| 1,547,390 | 7/1925 | Hatch | 238/347 X |
| 3,292,857 | 12/1966 | Hughes | 238/22 |
| 3,784,097 | 1/1974 | Landis | 238/310 |
| 3,858,804 | 1/1975 | Hixson | 238/264 |

*Primary Examiner*—Robert J. Spar
*Assistant Examiner*—Randolph A. Reese
*Attorney, Agent, or Firm*—Larson, Taylor and Hinds

[57] ABSTRACT

A restraining rail mounting assembly which supports a rail adjacent to a track for maintaining the wheels of railroad cars on the track while traversing dangerous curves or any area where derailing is a potential hazard. The mounting system is comprised of a support having a tongue and oblique slot for mounting a railroad track on its side and permitting adjustment on the space between the track and the restraining rail. The mounting assembly is comprised of a plate embedded in a cement pedestal with a second support plate for locking the rail support bracket also secured in the cement pedestal. The base of the rail support bracket has diagonally opposite extensions with the extension furthest from the rail having a serrated surface and matching lock washer to securely hold the restraining rail mounting bracket. The restraining rail mounting bracket has an abutment or foot for bracing the base flange on the restraining rail and a tongue extending outward from an angled slot having a mounting hole through which a bolt can pass to secure the web of the rail to the rail support bracket. Angled slots in the support plate compensate for longitudinal forces such as expansion and contraction of the rails due to temperature changes to maintain the spacing and alignment of the restraining rail and the track.

1 Claim, 6 Drawing Figures

Fig. 4
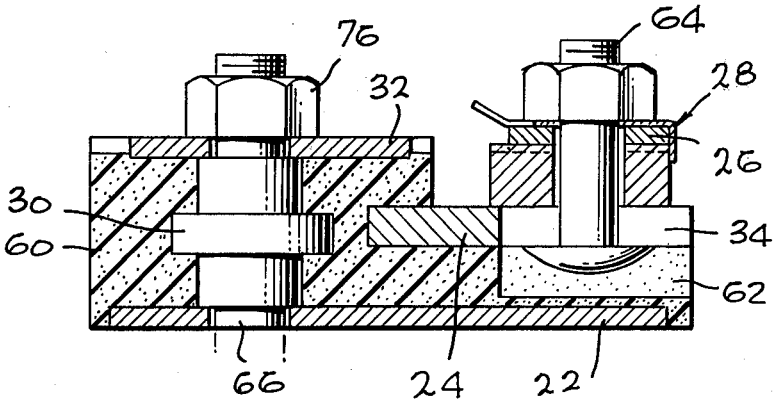
Fig. 5
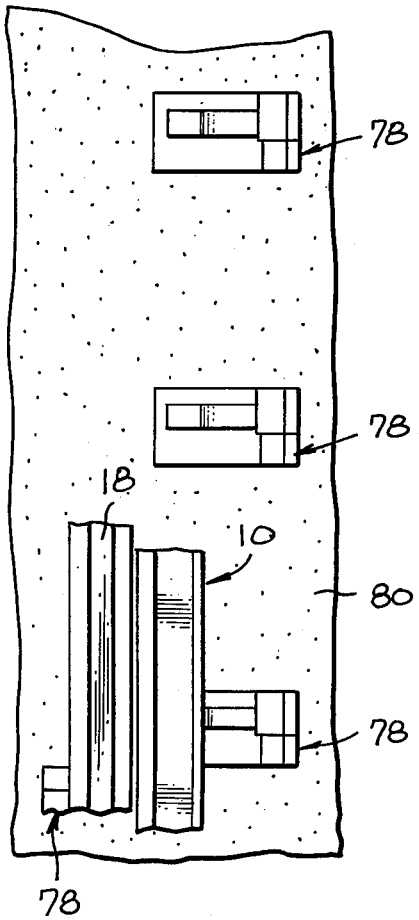
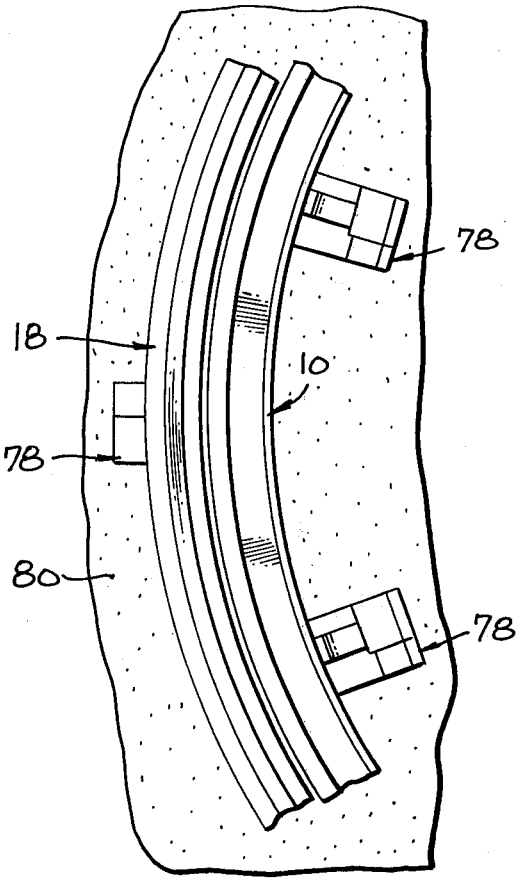
Fig. 6

RESTRAINING RAIL MOUNTING ASSEMBLY

BACKGROUND OF THE INVENTION

This invention relates generally to railroad safety devices and more particularly relates to restraining rail for maintaining railroad car wheels on the track in a potentially hazardous area.

The potential danger of derailment of trains in well known and precautions such as warning signs for hazardous areas are often use because of this. There have been numerous devices proposed such as devices which grip the wheel bearing flange on the track, but they have not been widely accepted because of the necessity of redesigning already existing railroad cars and their wheels. Therefore it would be advantageous if a safety device could be provided which would provide a margin of safety without modifying existing equipment. Of course, restraining rails of one type or another are not unknown but the difficulty of maintaining them at a useful spacing has always been a problem.

The present invention solves this problem by providing a mounting in which the spacing between the restraining rail and the track can be kept substantially constant through all types of expansions and contractions of the restraining rail rail and track. The restraining rail mounting assembly described herein is comprised of a restraining rail support which permits an ordinary railroad track to be used as a restraining rail by supporting it on its side. The web of the railroad track is firmly secured to a tongue portion of the restraining rail support with a vertically extending abutment or foot firmly bracing the base flange of the railroad track. The restraining rail mounting bracket is provided with a serrated adjusting base which permits the spacing between the restraining rail and track to be accurately set. In addition, a support plate embedded in the concrete pedestal for the restraining rail assembly has obliquely angled slots to compensate for longitudinal forces such as expansion and contraction of the restraining rail to prevent it from affecting the preset spacing.

It is one objecct of the present invention to provide a restraining rail mounting assembly which permits an ordinary railroad track to be used for the restraining rail.

Another object of the present invention is to provide a restraining rail mounting assembly which permits accurate adjustment of the spacing between the restraining rail and the track.

Yet another object of the present invention is a restraining rail mounting assembly which maintains the proper spacing through flucuations and expansions.

Other objects, advantages and normal features of the invention become apparent from the following detailed description of the invention when considered in conjunction with accompanying drawings, wherein like reference numbers identify like parts throughout the figures.

BRIEF DESCRIPTION OF THE DRAWINGS

FIG. 4 is a sectional view taken at 4—4 of FIG. 1.

FIGS. 5 and 6 are pictorial views of restraining rail systems.

DETAILED DESCRIPTION OF THE PREFERRED EMBODIMENT

Figure 1:
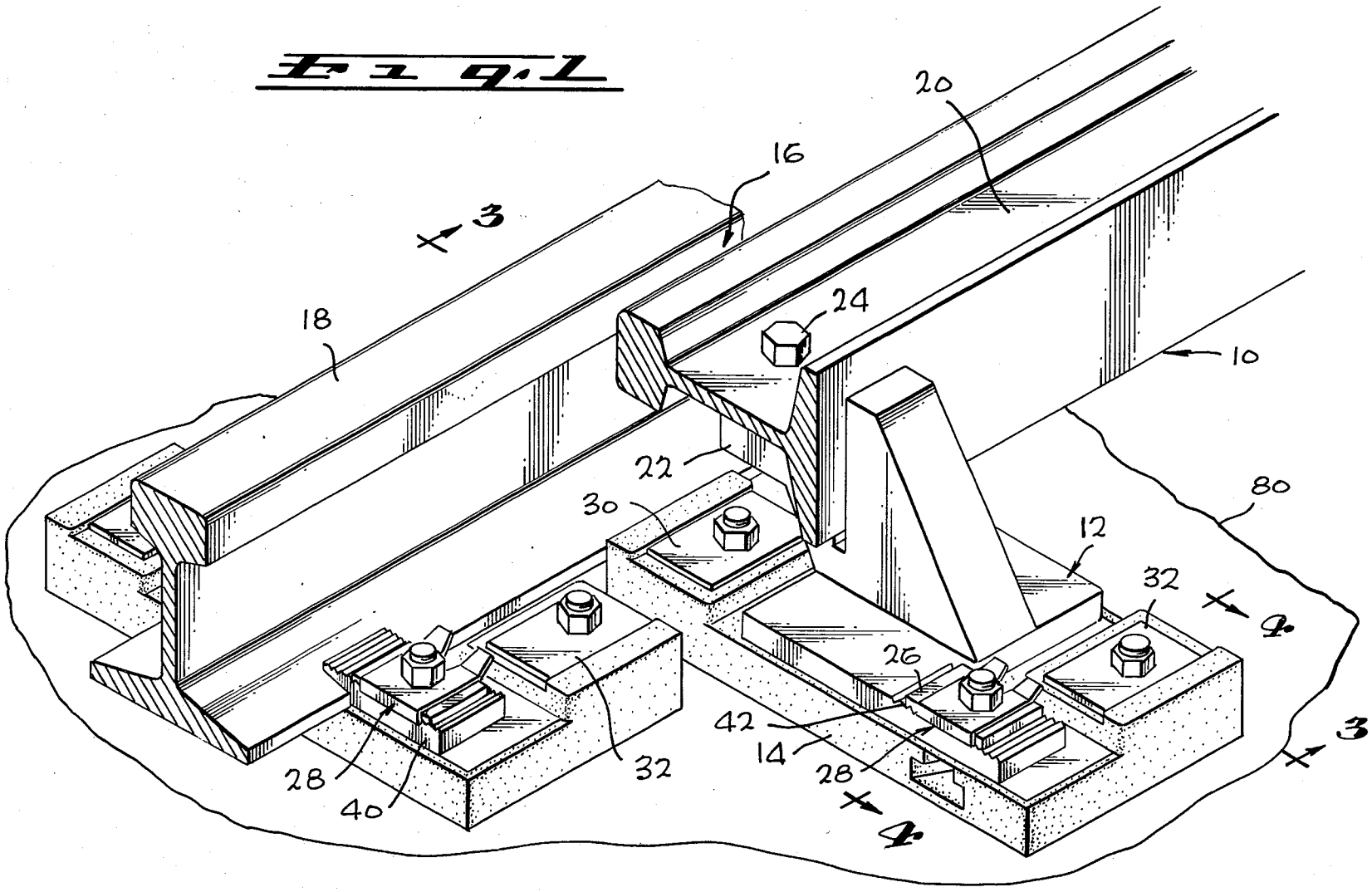
FIG. 1 is a perspective view of the restraining rail mounting assembly.

Referring to FIG. 1 there is shown in perspective view a restraining rail 10 attached to a restraining rail support bracket 12 which is fastened to a pedestal 14 for adjusting the spacing 16 between the restraining rail 10 and the track 18. The restraining rail 10 is a track supported on its side by its web 20 which is securely attached to a tongue 22 of the rail support bracket 12 by means of a bolt 24.

The restraining rail support assembly components are shown in exploded view 2 in which the insulating elastomer bonding material has been omitted for clarity. The rail support assembly is comprised of a base plate 22, a support plate 24 for attaching the rail support bracket 12, a serrated rectangular washer 26 for adjustment purposes and a nut locking clip 28. The assembly is fastened using an insulating insert 30 and a square washer 32 with only one being shown for simplicity. The support plate 20 is provided with oblique slots 34 and 36 to provide for load compensation of longitudinal forces such as expansion and contraction because of temperature variations. The rail support bracket 12 has diagonally opposite extensions 38 and 40 for adjustably securing the bracket to the support plate 24. The extension 38 has a plurality of serrations or ridges perpendicular to the long axis of slot 37 for locking the support bracket. The support bracket is locked by means of rectangular washer 26 which has corresponding parallel serrations 44 to match the serrations 42 of the base extension 38 of the support bracket 12. Locking clip 28 has bent flanges 48 and 50 which can be bent up around a nut to lock it after installation and adjustment is complete.

Figure 3:
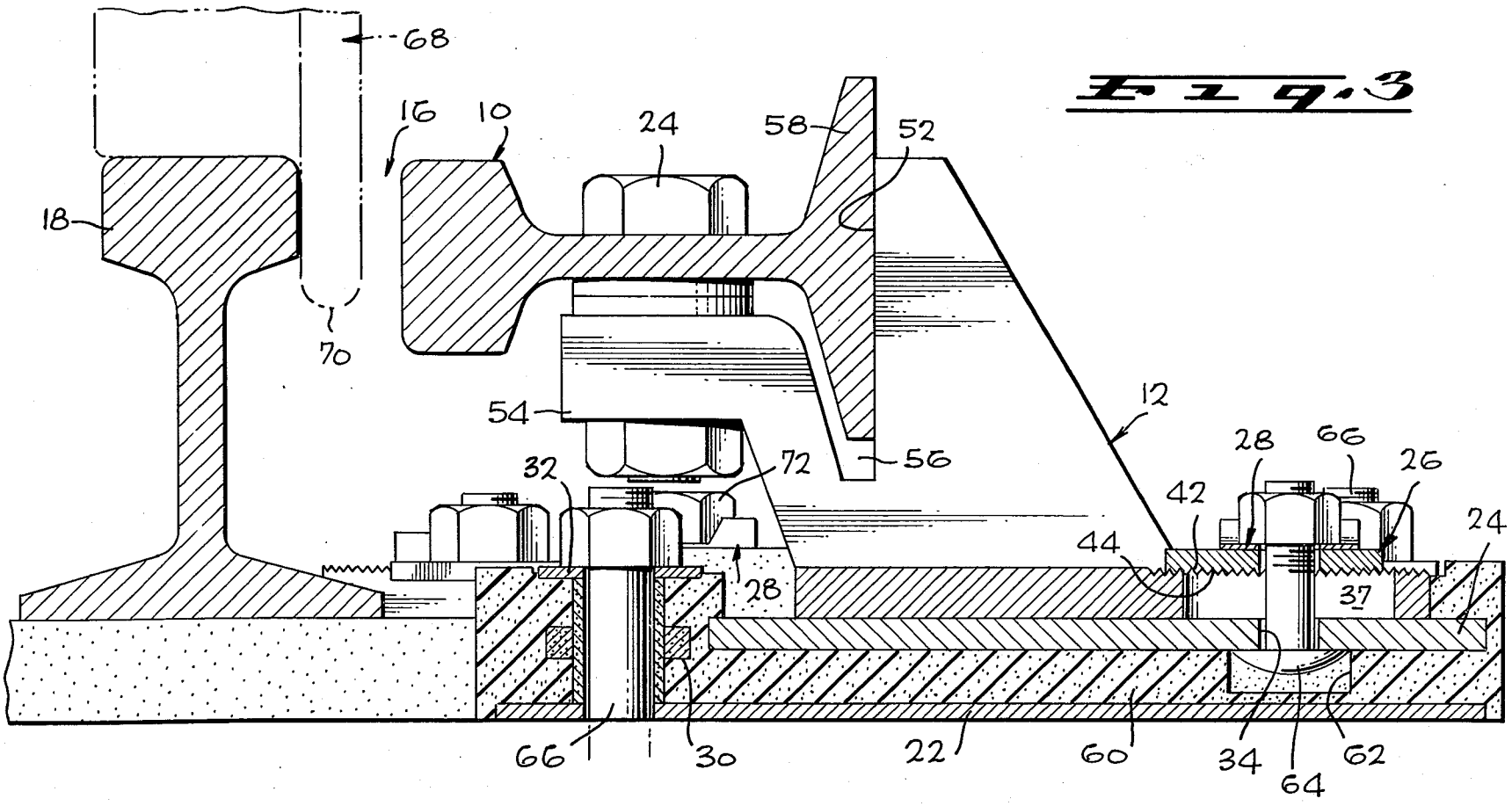
FIG. 3 is a cross-sectional side elevation taken at 3—3 of FIG. 1.

The rail support bracket 12 has a vertically extending abutment or foot 52 cooperating with tongue extension 54 and the groove or angle slot 56 to firmly brace and provide rigid support for restraining rail 10. FIGS. 3 and 4 illustrate the mounting of the restraining rail assembly and encapsulation with a suitable elastomer. In FIG. 3 a rail 10 is fastened to the tongue 54 of rail support bracket 12 with a bolt 24. The base flange 58 of rail 10 is firmly braced against abutment portion 52 of rail support bracket 12 with the flange fitting comfortably in V slot 56 configured to fit the base flange 58. The rail support bracket is mounted on support plates 24 which in turn are encapsulated in the elastomeric material in the usual manner. A cavity 62 is provided in the elastomeric material 60 to permit fastening of bolt 64 through the slot 34 of support plate 24. The bolt 64 passes through slotted holes 37 in the support plate 24 with serrated washer 44 engaging serrations 42 on the rail support bracket 12. This permits adjustment of the space 16 between the rail 10 and track 18. The support plate 24 and base plate 22 encapsulated in the elastomer 60 are securely held down by bolts 66 embedded in cement (not shown) with insulating insert 30 surrounding bolt 66 to insulate it from the support assembly.

FIG. 3 also illustrates the manner in which restraining rail 10 maintains a wheel 68 on track 18. The spacing 16 is adjusted such that the wheel 68 must be thrown vertically at least a sufficient distance to clear flange 70 in order to permit any derailment of the wheels, thus the restraining rail 10 prevents derailment of a railroad car except under the most severe conditions. It should be noted that the opposite diagonal end of rail support bracket 12 is secured by a bolt assembly 72 in the same manner as the bolt 64 secures the end having the serrations.

Figure 2:
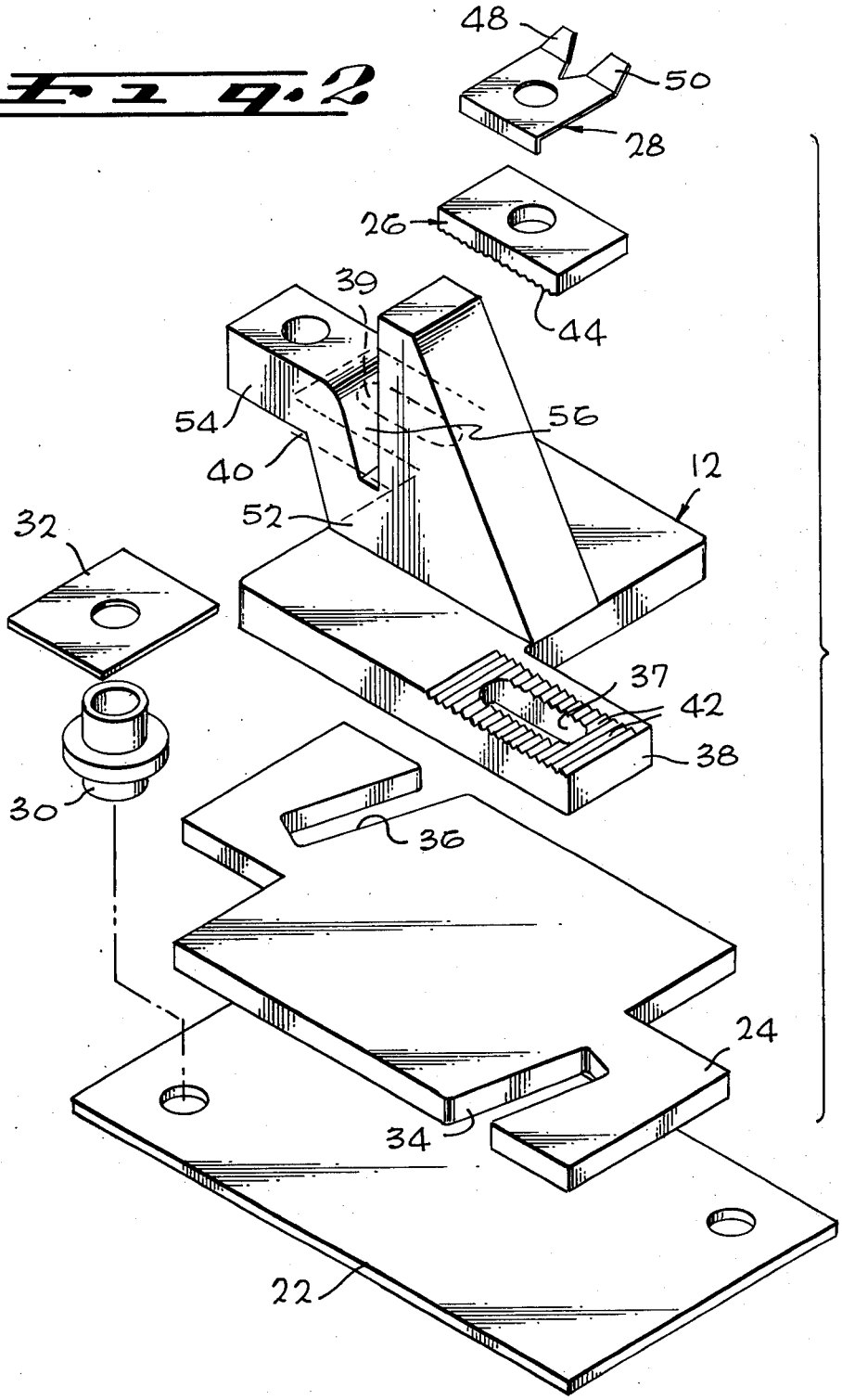
FIG. 2 is an exploded view of the various parts of the restraining rail mounting assembly.

FIG. 4 is a sectional view taken at 4—4 of FIG. 1 illustrating the manner in which the bolts 64 secure the rail support bracket 12 to the support plate 24. The head of bolt 64 engages oblique slot 34 and passes through support bracket 12 and serrated washer 26 with nut 74 being tightened down to securely hold the bracket 12. A nut locking clip 28 is provided to prevent rotation of the nut 74 after the restraining rail 10 has been properly adjusted. This is accomplished by bending up tabs 48 and 50 (FIG. 2) against nut 74. Support plate 24 is securely held by encapsulating elastomer 60 and bolt 66 embedded in cement (not shown) secured by a nut 76 and washer 32. An insulating insert 30 is provided around the bolt 66 to insulate the support assembly from ground in the usual manner.

FIGS. 5 and 6 illustrate restraining rail systems in which a number of support assemblies 78 are provided along a track bed 80. The restraining rail 10 is supported adjacent to a track 18 along the entire length of a portion which is considered a potential derailment hazard. FIG. 6 shows a typical assembly for providing a curved restraining rail 10 next to a curved track 18.

Obviously, many modifications, variations and departures may be made within the scope of the invention. It is therefore to be understood that the full scope of the invention is not limited to the details disclosed herein and may be practiced otherwise than as specifically described.

What is claimed is:

1. Apparatus for preventing the wheels of a railroad train or the like from leaving a railroad track, said apparatus comprising:

a restraining rail mounted parallel to and spaced a constant distance from the railroad track and comprising at least one piece of railroad track mounted on its side so that the head portion of the piece of track presents a restraining surface adjacent the railroad track;

mounting means mounting said restraining rail said constant distance from the track, said mounting means comprising a mounting bracket comprising a base portion, a tongue portion having a mounting hole therein for fixedly securing the web of the piece of track to said bracket and means defining a slot in which a portion of one side of the base flange of said piece of track is received, said slot defining means including an abutment portion engaging the bottom side of the base flange of said piece of track;

adjusting means for adjusting the position of said mounting bracket comprising means defining mounting slots in said base portion of said mounting bracket, means defining a serrated surface in said base portion surrounding one of said mounting slots, and a serrated washer engaging the serrated surface of said base portion; and bracket mounting and support means comprising a support plate secured in a mounting pedestal and including at least one bolt slot extending into said support plate from the edge thereof obliquely to said edge, and a bolt engaged in said bolt slot for securing bracket to said support plate.

* * * * *